US006664221B1

(12) United States Patent
Kresse et al.

(10) Patent No.: US 6,664,221 B1
(45) Date of Patent: Dec. 16, 2003

(54) MOP DETERGENTS

(75) Inventors: Franz Kresse, Hilden (DE); Klaus-Peter Bansemir, Langenfeld (DE); Heiko Faubel, Wermelskirchen (DE); Thomas Merz, Hilden (DE)

(73) Assignee: Ecolab GmbH & Co. oHG, Dusseldorf (DE)

( * ) Notice: Subject to any disclaimer, the term of this patent is extended or adjusted under 35 U.S.C. 154(b) by 0 days.

(21) Appl. No.: 10/009,111

(22) PCT Filed: May 24, 2000

(86) PCT No.: PCT/EP00/04723

§ 371 (c)(1), (2), (4) Date: Apr. 15, 2002

(87) PCT Pub. No.: WO00/75269

PCT Pub. Date: Dec. 14, 2000

(30) Foreign Application Priority Data

Jun. 2, 1999 (DE) ..... 199 25 274

(51) Int. Cl.[7] ..... C11D 14/02; D06L 14/02

(52) U.S. Cl. ..... 510/276

(58) Field of Search ..... 510/276, 269, 510/299, 37, 308, 312, 317, 318, 347, 356, 361, 378, 394, 436

(56) References Cited

U.S. PATENT DOCUMENTS 5,223,179 A * 6/1993 Connor et al. ..... 252/548
6,531,437 B1 * 3/2003 Ryan et al. ..... 510/280

FOREIGN PATENT DOCUMENTS

| | | |
|---|---|---|
| DE | 42 28 786 | 3/1994 |
| EP | 0 657 527 A | 6/1995 |
| EP | 0 913 117 A | 5/1999 |
| WO | WO 96/28534 A | 9/1996 |
| WO | WO 98/17760 | 4/1998 |

* cited by examiner

*Primary Examiner*—Yogendra N. Gupta
*Assistant Examiner*—John M. Petruncio
(74) *Attorney, Agent, or Firm*—Merchant & Gould P.C.

(57) ABSTRACT

The invention relates to agents and methods for washing articles containing foaming components.

15 Claims, No Drawings

MOP DETERGENTS

This invention relates to compositions and processes for washing articles containing foam-generating components.

Compositions for washing articles are known in principle. Institutional laundries use detergents containing the usual washing aids such as, for example, alkali donors, complexing agents and surfactants. These detergents are used in discontinuous or continuous washing machines. Continuous washing machines comprise a number of washing compartments arranged in tandem so that the articles to be washed are continuously transported from washing compartment to washing compartment during the washing process while the washing medium—consisting of the aqueous solution of the detergent and the soils introduced—normally flows in countercurrent to the transported articles. Discontinuous washing machines generally consist of a single washing compartment provided with drum having a perforated wall for holding the articles to be washed. The articles to be washed are first treated in the above-mentioned washing medium and then repeatedly rinsed with fresh washing medium. The detergents and processes have a number of disadvantages when it comes to washing articles containing foaming components.

In the machine washing of articles containing large quantities of foaming substances, generally surfactants, overfoaming occurs in the washing machine where the usual detergents, so-called heavy-duty detergents, are used in the washing process. Typical heavy-duty detergents contain around 10% by weight surfactant, based on the detergent as a whole, and are dosed in a concentration of 0.3 to 1.2% by weight, based on the detergent solution as a whole. Under the described conditions, technical problems can be caused by foaming in the washing of articles containing foaming substances, with the result that the wash program is disrupted and the washing results are impaired. The foam dampens the tumbling action of the washing machine in the wash process, resulting in a reduction in the mechanical cleaning force.

Another disadvantages of the detergents in use today arises when it comes to washing articles used for cleaning purposes. Cleaning utensils, such as mops, flat wiping heads, window cloths and cleaning cloths, are used for cleaning surfaces, especially in the professional cleaning of buildings, and are then washed in automatic washing machines. After they have been used, the cleaning utensils are soiled with surfactant-containing surface cleaning compositions and soil. Where the washing process is carried out with the heavy-duty detergents normally used, above-average quantities of incrusting soils remain behind in the washed utensils and, after drying, increase mechanical material wear and abrasion which accelerates premature destruction of the utensil. In addition, the large quantities of soil contribute greatly to the utensils discoloring rapidly and leaving an unhygienic impression behind after only a few wash cycles. Apart from these disadvantages in the washing process and washing results, the overly high proportion of surfactants in typical heavy-duty detergents is a disadvantage when the washing process is viewed from the perspective of environmental aspects and the introduction of surfactants into the wastewater.

The problem addressed by the invention was to provide a detergent and a process which would be suitable for washing articles containing foaming substances without increasing the generation of foam during the washing process.

Another problem addressed by the invention was to provide a detergent and a process which, particularly in the case of heavily pigment-soiled articles for washing, would contribute towards the articles retaining a high quality and towards an increase in their useful life, even after several soiling/washing cycles.

A further problem addressed by the invention was to provide a detergent and a process designed in such a way that the articles for washing would achieve an at least 10% larger number of life cycles (comprising their use, washing and drying) compared with typical heavy-duty detergents before they are mechanically destroyed.

The object of the present invention was to use detergents and processes—in contrast to the prior art cited above—for the machine washing of articles containing foam-generating substances and to formulate the detergents in such a way that they would not increase the generation of foam during the washing process. In the detergents according to the invention, the percentage surfactant content, based on the total quantity of detergent, is less than 6% by weight, preferably less than 3% by weight and more particularly less than 1.5% by weight. In one special embodiment, the detergents contain no surfactant at all.

In addition, an increase in useful life of at least 10% before destruction by wear and abrasion of the articles is achieved by using complexing agents in concentrations of 0.1 to 5% by weight and preferably 0.5 to 3% by weight, based on the detergent as a whole.

In addition, the appearance of the articles for washing is improved in relation to the prior art by using redeposition inhibitors in concentrations of 0.1 to 5% by weight and preferably 0.5 to 3% by weight, based on the detergent as a whole.

The detergent may contain one of more constituents from the groups of builders as softeners and/or alkali donors, bleaching agents, brighteners and biocides in the following quantities, based on the total quantity of detergent: 10 to 60 and preferably 20 to 50% by weight softeners, 5 to 40 and preferably 10 to 20% by weight alkali donors, 5 to 30 and preferably 10 to 20% by weight bleaching agents, 0.1 to 10 and preferably 0.5 to 5% by weight brighteners, 0.1 to 10 and preferably 0.3 to 5% by weight biocides.

The present invention also relates to a process for using the detergents according to the invention for washing articles soiled with surfactants, characterized in that, to remove soils, the articles for washing are treated with a detergent solution obtainable by dissolving or dispersing the detergent according to the invention in water, the process being carried out at temperatures of the washing medium of 30 to 90° C. and preferably 40 to 70° C. and the washing process being carried out with the assistance of mechanical action.

Examples of articles for washing which contain surfactants and a high percentage of soil from their intended uses are mops, flat wiping heads, window cloths and cleaning cloths.

Another feature of the process according to the invention is the optimal co-operation of the soil constituents in the article for washing with the ingredients of the detergent for achieving an optimal result in terms of cleaning performance, the completion of the washing process and the introduction of surfactants into the environment. The process may be carried out, for example, by cleaning soiled surfaces with materials intended for that purpose which have been conditioned with surfactant-containing cleaning compositions and, after the cleaning process, treating the now soiled surfactant-containing materials as articles for washing with a detergent solution prepared by dissolving or dispersing a detergent according to the invention in water in the manner described above in reference to the process according to the invention.

Examples of articles suitable for such a process are mops, flat wiping heads, window cloths and cleaning cloths. The cleaning compositions are, for example, surfactant-containing cleaning compositions for hard surfaces.

As already mentioned, the detergents according to the invention may contain surfactants in limited concentrations. If surfactants are used in the detergents according to the invention, they are preferably low-foaming nonionic surfactants such as, for example, $C_{12-18}$ alkyl polyethylene glycol polypropylene glycol ethers containing up to 8 moles ethylene oxide units and up to 8 moles propylene oxide units in the molecule. However, other nonionic surfactants known for their low foaming such as, for example, $C_{12-18}$ alkyl polyethylene glycol polybutylene glycol ethers containing up to 8 moles ethylene oxide units and up to 8 moles butylene oxide units in the molecule and end-capped alkyl polyalkylene glycol mixed ethers may also be used.

The following factors should be taken into consideration in the formulation of the detergents according to the invention with builders or special complexing agents.

In principle, the builder present in the detergents according to the invention may be any substance known in the prior art as a builder suitable in the broadest sense for detergents and cleaning compositions, builders preferably being used. Coated builders as known from the prior art may also be used and may even be preferred in cases where chlorine-containing bleaching agents are used.

Suitable builders are, for example, alkali metal phosphates which may be present in the form of their sodium or potassium salts. Examples of such builders are tetrasodium diphosphate, pentasodium triphosphate, so-called sodium hexametaphosphate and the corresponding potassium salts or mixtures of sodium hexametaphosphate and the corresponding potassium salts or mixtures of sodium and potassium salts.

In addition, complexing agents, such as nitrilotriacetate or ethylene diamine tetraacetate for example, may be used as builders. Soda and borax are also suitable builders for the purposes of the present invention.

Other possible water-soluble builder components are, for example, organic polymers or native or synthetic origin, above all polycarboxylates. Suitable builder components of this type are, for example, polyacrylic acids and copolymers of maleic anhydride and acrylic acid and the sodium salts of these polymer acids. Commercially available products are, for example, Sokalan® CP 5 and PA 30 (BASF), Alcosperse® 175 and 177 (Alco), LMW® 45 N and SPO2 ND (Norsohaas). Suitable native polymers include, for example, oxidized starch (for example DE 42 28 786) and polyamino acids, such as polyglutamic acid or polyaspartic acid, for example as manufactured by Cygnus, Bayer AG, Rohm & Haas, Rhône-Poulenc of SRCHEM.

Other possible builder components are naturally occurring hydroxycarboxylic acids such as, for example, monohydroxy and dihydroxysuccinic acid, α-hydroxypropionic acid, citric acid, gluconic acid and salts thereof. Citrates are preferably used in the form of trisodium citrate dihydrate.

Amorphous metasilicates or layer silicates may also be used as builders. Crystalline layer silicates are also suitable builders providing they are sufficiently alkali-stable. Crystalline layer silicates are marketed, for example, by Hoechst AG (Germany) under the trade name Na-SKS, for example Na-SKS-1 ($Na_2Si_{22}O_{45}.xH_2O$, kenyaite) Na-SKS-2 ($Na_2Si_{14}O_{29}xH_2O$, magadiite), Na-SKS-3 ($Na_2Si_8O_{17}.xH_2O$), Na-SKS4 ($Na_2Si_4O_9.xH_2O$, makatite), Na-SKS-5 ($\alpha$-$Na_2Si_2O_5$), Na-SKS-7 ($\beta$-$Na_2Si_2O_5$). natrosilite), Na-SKS-11 ($\tau$-$Na_2Si_2O_5$) and Na-SKS-6 ($\delta$-$Na_2Si_2O_5$).

Particularly preferred builders are selected from the group consisting of pentasodium triphosphate, trisodium citrate, nitrilotriacetate, ethylenediamine tetraacetate or mixtures thereof.

Other suitable components are methyl glycine diacetate and alkali metal salts of phosphonic acids such as, for example, 1-hydroxyethane-1,1-diphosphonate, diethylene triamine pentamethylene phosphonate and ethylene diamine tetramethylene phosphonate.

The function of the redeposition inhibitors present in the detergent according to the invention is to keep the soil detached from the fibers suspended in the liquor and thus to prevent re-absorption of the soil. Suitable redeposition inhibitors are water-soluble, generally organic colloids, for example the water-soluble salts of polymeric carboxylic acids, glue, gelatin, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (Na salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone may also be used, for example in quantities of 0.1 to 5% by weight, based on the detergent.

Bleaching agents, for example sodium perborate, even in the form of its hydrates, or sodium percarbonate or from the group of chlorine-based bleaching agents, such as N-chloro-p-toluenesulfonic acid amide, trichloroisocyanuric acid, alkali metal dichloroisocyanurate, alkali metal hypochlorites and compositions releasing alkali metal hypochlorites, may also be used, alkali-stable bleaching compositions being particularly preferred. Such compositions may be both alkali-stable substances or components stabilized by suitable methods, for example by surface coating or passivation.

Suitable brighteners are, for example, salts of 4,4'-bis-(2-anilino4-morpholino-1,3,5-triazinyl-6-amino)-stilbene-2, 2'-disulfonic acid and compounds of similar structure which, instead of the morpholino group, contain a diethanolamino group, a methylamino group, an anilino group or a 2-methoxyethylamino group. Brighteners of the substituted diphenylstyryl type, for example the alkali metal salts of 4,4'-bis-(2-sulfostyryl)-diphenyl, 4,4'-bis-(4-chloro-3-sulfostyryl)-diphenyl or 4-(4-chlorostyryl)-4'-2-sulfostyryl)-diphenyl, may also be present.

Where biocides are used, halogen-containing compounds, such as dichloroisocyanurate or other halogen donors, such as chloramine T or bormohydantoins or triclosan, are preferred. However, the usual biocides, such as aldehydes, amines and others, may also be used.

The processes and compositions according to the invention have a number of advantages.

Thus, by reducing the surfactant content of the detergent, the surfactant content of the washing medium can be reduced so that there is no increase in foaming during the washing process and, in addition, a better cleaning result is obtained.

Another effect of the lower surfactant content in the washing medium is that the wastewater is less polluted.

Another advantages arise when it comes to washing articles which, before washing, have been used to clean surfaces. Thus, it has been found that, in the washing of soiled mops and flat wiping heads, the relatively high percentage of complexing agents in the product enables the level of incrusting soils remaining behind after washing and drying to be reduced. In this way, the premature destruction of utensils can be prevented and the number of use cycles increased accordingly.

Articles for washing which are used to clean surfaces are normally heavily soiled before washing with the result that discoloration can be observed after only a few use and wash cycles. The levels of redeposition inhibitors present in typical heavy-duty detergents are not sufficient to counteract discolouration. One advantage of the processes and compositions according to the invention is that the dicolouring effect is counteracted by increasing the percentage content of redeposition inhibitors.

The major advantage of the compositions and processes according to the invention is achieved when soiled articles, such as mops or window cloths etc., are washed on their own. This is done above all by institutional service providers. The soiled washing cloths are collected and washed on their own in automatic washing machines.

EXAMPLES

A process cycle typically used for mops is as follows:

| | |
|---|---|
| Miele automatic washing machine: | 5 kg |
| Mop heads: | 20 per machine |
| Detergent: | 125 g per machine |
| Washing process: | single-bath process with all rinse cycles |
| Water hardness | 2 mmoles $Ca^{++}$ or $Mg^{++}$ per liter |
| Liquor ratio: | 1:5 |
| Temperature | 60° C. |
| Soiling | The mops had been used under comparable conditions in practice. |
| Wiping/washing cycles | 30 |

Tests were carried out to this specification. The mop heads were alternately washed and used in practice. They were consecutively numbered and could always be subjected to the same conditions.

Example

Comparative tests with various detergent formulations were carried out to the above specification.

| | Formulation ingredients (percentage active substance) | | |
|---|---|---|---|
| Ingredients | A | B | C (comparison) |
| Hydroxyethane diphosphonate (Na salt) | 1.1% | 0.6% | 0.3 |
| Acrylic acid/maleic acid copolymer | 5.0% | — | 3.5 |
| Carboxymethyl cellulose | 1.7% | 2.0% | — |
| Citrate 2 $H_2O$ | 3.0% | — | — |
| 7:3 (10%) paraffin/silicone oil mixture on soda | 2.0% | — | 2.0% |
| Perborate mono | 12.0% | 12.0% | 12.0% |
| TAED granules | 3.1% | 3.1% | 3.1% |
| Soda calc. | 36.9 | 28.2% | 10.5% |
| Na zeolite A powder | 35.1% | 20.0% | 25% |
| Phosphate | — | 30.0% | — |
| Anionic surfactant (ABS) | | 4.0% | 8.0% |
| Nonionic surfactant ($C_{12/14}$ FA + 5 EO) | | | 4.0% |

-continued

| | Formulation ingredients (percentage active substance) | | |
|---|---|---|---|
| Ingredients | A | B | C (comparison) |
| Optical brightener | 0.1% | 0.1% | 0.1% |
| Protease | | | 0.2% |
| Balance to 100% $Na_2SO_4$ | | | 31.3% |
| Total | 100.0% | 100.0% | 100.0% |

Example 1

When carrying out the washing processes, it was found that formulation C produced far more foam than formulations A and B. Where formulation C was used, the foam it generated caused program faults in the washing machine and, accordingly, unwanted disruption in 5 out of the 30 washing processes. Where formulations A and B were used, there was no disruption in any of the 30 washing processes.

After it had been used and washed 30 times, the utensil was assessed for appearance to enable any differences in appearance to be determined.

The visual evaluation is documented in Table 1. The appearance of the mops after the 30th wash is more favorable where formulations A and B are used than it is in the case of formulation C. This means that, in repeated use/wash cycles, formulations A and B produce better washing results and a better appearance of the mops

TABLE 1

Visual evaluation of appearance

| | Visual evaluation of appearance | |
|---|---|---|
| | Cleaning side | Back |
| When new | 1 | 1 |
| After 30th use (A,B,C) | 10 | 7 |
| After 30th wash | | |
| A | 6 | 6 |
| B | 5 | 5 |
| C | 7 | 7 |

Linear evaluation scale:
1 = like a new mop
10 = appearance on cleaning side after 30th use The quality of the mops is also less affected where formulations A and B are used than where comparison detergent C is used, as can be seen from Table 2.

TABLE 2

Percentage ash and loss of ultimate tensile strength of mops after 30th wash compared with the new state as a function of the detergent used

| | Detergent according to the invention with | | |
|---|---|---|---|
| | A | B phosphate/zeolite | C |
| Ash | 0.8% | 0.4% | 1.0% |
| Loss of ultimate tensile strength | 5.0% | 4.9% | 7.1% |

To support the visual assessment, the whiteness of the mops after the 30th wash was also photometrically determined.

Whiteness was measured with a Minolta CR 200 reflectance colorimeter coupled to a PC in which the measured values were further processed. Whiteness was measured against a white standard: MgO plate =100 reflection. Four cleaned strips were each measured 28 times, the final result being expressed as the average of the 28 measured values.

TABLE 3

| Evaluation of the whiteness of mops after the 30th wash by comparison with the starting value in the new state | |
|---|---|
| | "High-speed" mop (RTX 5 S) % reflection (Minolta CR 200) |
| After 30th wash: | |
| Product A | 60.8% |
| Product B | 64.0% |
| Product C | 52.4% |
| Starting value (when new) | 88.6% |

The reflection values also show that formulations A and B are superior to formulation C.

Where 125 g of detergents A and B are used, 5 g of surfactants enter the wastewater per wash cycle; where detergent C is used, 15 g of surfactants pass into the wastewater. It is thus easy to see that formulations A and B are also advantageous from the ecological perspective.

What is claimed is:

1. A process for machine washing articles containing soil and foam-generating surfactants, the method comprising steps of:

(a) dissolving or dispersing a detergent in water to provide a detergent solution, the detergent comprising:

(i) between 0.1 and 5% by weight complexing agent based on the weight of the detergent;

(ii) surfactant, if present at all, present in an amount of less than 6% by weight based on the weight of the detergent; and (b) machine washing the articles containing soil and foam-generating surfactants with the detergent solution, the articles comprising at least one of mops, flat wiping heads, window cloths, and cleaning cloths, and wherein the detergent solution does not increase foaming during the step of machine washing compared with machine washing the articles without the detergent solution.

2. A process according to claim 1, wherein the surfactant, if present at all, is present in the detergent in an amount of less than 3% by weight based on the weight of the detergent.

3. A process according to claim 1, wherein the surfactant, if present at all, is present in the detergent in an amount of less than 1.5% by weight based on the weight of the detergent.

4. A process according to claim 1, wherein the detergent contains no surfactant.

5. A process according to claim 1, wherein the detergent comprises between 0.5 and 3% by weight complexing agent based on the weight of the detergent.

6. A process according to claim 1, wherein the detergent further comprises 0.1 to 5% by weight redeposition inhibitor based on the total weight of the detergent.

7. A process according to claim 6, wherein the detergent comprises 0.5 to 3% by weight redeposition inhibitor based on the total weight of the detergent.

8. A process according to claim 1, wherein the detergent comprises at least one of builders, bleaching agents, brighteners, and biocides.

9. A process according to claim 1, wherein the detergent comprises a builder selected from at least one of softeners and alkali donors.

10. A process according to claim 1, wherein the detergent comprises:

(a) 10 to 60% by weight softener;

(b) 5 to 40% by weight alkali donor;

(c) 5 to 30% by weight bleaching agent;

(d) 0.1 to 10% by weight brightener; and (e) 0.1 to 10% by weight biocide, wherein the weights percentages are based on the weight of the detergent.

11. A process according to claim 1, wherein the detergent further comprises:

(a) 20 to 50% by weight softener;

(b) 10 to 20% by weight alkali donor;

(c) 10 to 20% by weight bleaching agent;

(d) 0.5 to 5% by weight brightener; and (e) 0.3 to 5% by weight biocide, wherein the weight percentages are based on the weight of the detergent.

12. A process according to claim 1, wherein the step of machine washing comprises providing the detergent solution at a temperature of between 30° C. and 90° C.

13. A process according to claim 1, wherein the step of machine washing comprises providing the detergent solution at a temperature of between 40° C. and 70° C.

14. A process according to claim 1, wherein the step of machine washing comprises mechanically agitating the articles in the detergent solution.

15. A process according to claim 1, wherein the step of machine washing comprises machine washing a load that includes only articles containing soil and foam-generating surfactants.

* * * * *